US008561665B2

(12) United States Patent
Lin

(10) Patent No.: US 8,561,665 B2
(45) Date of Patent: Oct. 22, 2013

(54) SAFETY MECHANISM FOR TOP DOWN BOTTOM UP SHADES

(75) Inventor: Tzong-Fu Lin, Taipei (TW)

(73) Assignee: Whole Space Industries Ltd, Taipei (TW)

( * ) Notice: Subject to any disclaimer, the term of this patent is extended or adjusted under 35 U.S.C. 154(b) by 69 days.

(21) Appl. No.: 13/245,927

(22) Filed: Sep. 27, 2011

(65) Prior Publication Data

US 2013/0075045 A1 Mar. 28, 2013

(51) Int. Cl.
*A47H 5/00* (2006.01)

(52) U.S. Cl.
USPC ..... 160/84.03; 160/167 R

(58) Field of Classification Search
USPC ..... 160/84.04, 173 R, 84.01, 84.05, 84.03, 160/178.1 R, 115, 168.1 R, 167 R, 293.1, 160/169, 170
See application file for complete search history.

(56) References Cited

U.S. PATENT DOCUMENTS 62,765 A * 3/1867 Matchett ..... 160/133
1,091,656 A * 3/1914 Harnly ..... 160/254
2,283,640 A * 5/1942 Kwon ..... 160/167 R
2,920,695 A * 1/1960 Bennett ..... 160/167 R
3,192,991 A * 7/1965 Anderle ..... 160/167 R
3,528,477 A * 9/1970 Abraham ..... 160/84.03
3,552,473 A * 1/1971 Persson ..... 160/172 R
4,733,711 A * 3/1988 Schon ..... 160/84.03
4,813,468 A * 3/1989 Fraser ..... 160/84.03
4,842,034 A * 6/1989 Haines ..... 160/84.04
5,443,108 A * 8/1995 LeVert et al. ..... 160/167 R
5,791,390 A 8/1998 Watanabe
5,839,494 A 11/1998 Judkins
6,164,362 A * 12/2000 Yang ..... 160/84.04
6,397,918 B1 * 6/2002 Chu ..... 160/167 R
6,516,856 B2 * 2/2003 Lai ..... 160/89
6,530,413 B2 * 3/2003 Hwang ..... 160/84.03
6,550,520 B1 * 4/2003 Rossini et al. ..... 160/107
6,834,701 B2 * 12/2004 Colson et al. ..... 160/121.1
7,028,737 B2 * 4/2006 Hsu ..... 160/84.03
7,063,122 B2 * 6/2006 Colson et al. ..... 160/84.03
7,143,802 B2 * 12/2006 Strand et al. ..... 160/84.04
7,520,311 B2 * 4/2009 Drew ..... 160/171
7,571,756 B2 * 8/2009 Smith et al. ..... 160/121.1
7,617,859 B2 * 11/2009 Auger ..... 160/121.1
7,686,059 B2 * 3/2010 Jarosinski et al. ..... 160/84.03
7,740,045 B2 * 6/2010 Anderson et al. ..... 160/84.05
7,832,450 B2 * 11/2010 Brace et al. ..... 160/84.05
7,866,367 B2 * 1/2011 Liang et al. ..... 160/173 R
7,984,743 B2 * 7/2011 Rossato ..... 160/84.05

(Continued)

*Primary Examiner* — Katherine Mitchell
*Assistant Examiner* — Johnnie A Shablack
(74) *Attorney, Agent, or Firm* — Buchanan Ingersoll & Rooney PC

(57) ABSTRACT

A window covering includes a first set of lift cords extending from a headrail to middle rail. The first set of lift cords is extendable between the headrail and the middle rail to a predetermined distance, which defines a lowermost position of the middle rail relative to the headrail. The first set of lift cords is also retractable to a wound position for defining an uppermost position of the middle rail. A second set of lift cords extends from the headrail to the bottom rail and is extendable from between the middle rail and bottom rail to define an extended position of window covering material. The predetermined distance that the first set of lift cords may extend is selected to help prevent children from becoming entangled in the first set of lift cords when the middle rail is lowered away from the headrail.

23 Claims, 5 Drawing Sheets

(56) References Cited

U.S. PATENT DOCUMENTS

| | | | | |
|---|---|---|---|---|
| 8,365,797 | B2 * | 2/2013 | Drew et al. | 160/84.05 |
| 2004/0016514 | A1 * | 1/2004 | Nien | 160/115 |
| 2006/0196612 | A1 * | 9/2006 | Strand et al. | 160/84.05 |
| 2006/0231214 | A1 | 10/2006 | Whyte et al. | |
| 2007/0068636 | A1 * | 3/2007 | Yu et al. | 160/168.1 R |
| 2007/0144686 | A1 * | 6/2007 | Drew | 160/170 |
| 2007/0209765 | A1 * | 9/2007 | Lin | 160/84.04 |
| 2008/0083509 | A1 * | 4/2008 | Hsu et al. | 160/84.05 |
| 2008/0149280 | A1 * | 6/2008 | Smith et al. | 160/121.1 |
| 2008/0196843 | A1 * | 8/2008 | Nien et al. | 160/178.1 R |
| 2008/0230189 | A1 * | 9/2008 | Rossato et al. | 160/115 |
| 2008/0277074 | A1 * | 11/2008 | Lin | 160/166.1 |
| 2008/0277076 | A1 * | 11/2008 | Cheng | 160/167 R |
| 2011/0005690 | A1 | 1/2011 | Harding | |
| 2011/0265963 | A1 * | 11/2011 | Drew et al. | 160/340 |

* cited by examiner

SAFETY MECHANISM FOR TOP DOWN BOTTOM UP SHADES

FIELD OF THE INVENTION

The present invention relates to window coverings known as top down bottom up shades.

BACKGROUND OF THE INVENTION

Top down bottom up shades usually have a headrail, a bottom rail and a middle rail between the headrail and middle rail. The middle rail is moveable for substantially the entire length along which the shade may be extended. Usually this length extends from just below the headrail to a bottom most position that is adjacent the bottom rail. Window covering material extends between the middle rail and the bottom rail and is moveable between an extended fully lowered position and a retracted fully raised position, based on the positioning of the middle rail and bottom rail. The middle rail is configured to travel throughout the path of travel along which the window covering material may be moved to permit a full range of adjustment options to a user. Examples of top down bottom up shades may be appreciated from U.S. Pat. Nos. 5,839,494 and 5,791,390 and U.S. Patent Application Publication Nos. 2006/0231214 and 2011/0005690.

The full range of motion of the middle rail may pose a risk to small children as lift cords extending between the middle rail and the headrail may be exposed to the children. For example, when the middle rail is in a lowermost position adjacent the bottom rail, a child may be able to touch or interact with such exposed cords. Exposure to such cords could also result in a child becoming entangled in the cords, which can pose a strangulation danger to a child.

Prior to the present invention, the industry has not recognized the potential strangulation risk of a fully lowered top down bottom up shade. This failure to recognize the potential problem may be attributable to the fact that most of the reported child entanglements have involved Venetian blinds and Roman shades. Yet, the same risks exist in a fully lowered top down bottom up shade, particularly if the lift cords for the middle rail are free to move through the headrail.

There has been much discussion about the length that pull cords may extend from a blind without causing a risk of child entanglement. Obviously, if the child cannot reach the cord, then the cord poses no risk. Consequently, window covering manufacturers are now offering window blinds with retractable cords. It is becoming generally accepted in the industry that such retractable cords do not pose a risk of child entanglement if the cord, when fully retracted, does not extend more than twelve inches from the headrail.

A new top down bottom up shade is needed in which the middle rail cannot be lowered to a point at which the lift cords for the middle rail create a risk of child entanglement. Applying the experience and consensus concerning retractable pull cords indicates that top down bottom up shades in which the middle rail cannot be lowered more than twelve inches would not create a risk of child entanglement.

SUMMARY OF THE INVENTION

A window covering includes a headrail, a bottom rail, and a middle rail positioned between the headrail and the bottom rail. Window covering material is positioned between the middle rail and the bottom rail. The window covering material is moveable from a retracted position to an extended position. A first set of lift cords extends from the headrail to the middle rail. The first set of lift cords is extendable between the headrail and the middle rail to a predetermined distance. The predetermined distance defines a lowermost position of the middle rail relative to the headrail. The first set of lift cords is retractable to a wound position for defining an uppermost position of the middle rail. A second set of lift cords extends from the headrail to the bottom rail. The second set of lift cords extends through the middle rail and bottom rail to define the extended position of the window covering material and is retractable to raise the bottom rail to define the retracted, fully raised position of the window covering material. The fully raised position of the bottom rail may also be referred to as the uppermost position of the bottom rail. A fully lowered position of the bottom rail may be the position the bottom rail is in when it is in its lowermost position. The predetermined distance about which the first set of lift cords is extendable is less than a distance between the bottom of the middle rail when the middle rail is in the uppermost position of the middle rail and the top of the bottom rail when the bottom rail is in the lowermost position of the bottom rail.

The predetermined distance is preferably determined such that the first set of lift cords extends out of the headrail and to the middle rail by at most twelve inches. In one embodiment, the predetermined distance may be twelve inches or less. It is contemplated that for some applications the predetermined distance could be larger or smaller. For instance, a window covering to be mounted on a very high window opening may have a larger distance to which the first set of cords that control the middle rail could be extended without posing a danger to a child.

In some embodiments, the window covering may also include at least one travel limiting device attached to at least one of the headrail and the middle rail. The at least one travel limiting device may be configured to prevent the first set of lift cords from extending beyond the predetermined distance. For example, a travel limiting device may include one or more spools of travel limiting cord that limit the number of rotations of the shaft about which the first set of lift cords are wound. The first set of lift cords may be unwound from the spool until the predetermined distance is reached at which point the travel limiting cord may be fully unwound. Since the unwound cord is no longer able to move from between the spool and shaft, it prevents the shaft from further rotating, which prevents the first set of cords from further extending from the headrail. In alternative embodiments, one or more brake mechanisms or releasable locks could alternatively be used to prevent the first lift cords from extending past the predetermined distance.

Some embodiments of the window covering may include a rotatable shaft adjacent the headrail. The first set of lift cords can be windable about the rotatable shaft and may also be unwindable from the rotatable shaft. In some embodiments the first set of lift cords may be directly wound on and unwound from the shaft. In other embodiments, one or more spools attached to the shaft may be used for collecting and unwinding the first set of lift cords. For instance, at least one spool may be attached to the shaft. The first set of lift cords is windable on the at least one spool when the shaft rotates in a first direction and the first set of lift cords is unwindable from the at least one spool when the shaft rotates in a second direction that is opposite the first direction. A motor, spring motor, loop cord drive or other actuation mechanism may be attached to the rotatable shaft. As another example, an operator cord that extends from the shaft through a cord lock attached to the headrail may be an actuation mechanism used in embodiments of the window covering. The operator cord may be at least one separate cord windable and unwindable about the shaft or may be portions of the first set of lift cords that extend through the cord lock.

It should be appreciated that the window covering material may be of any type of material suitable for use in window coverings. For example, the window covering material may be comprised of pleated material, cellular material, slats on ladders, fabric material, interconnected fabric segments, non woven fabric material, woven grass or woven wood.

Each of the lift cords may be any type of elongated member that is extendable from the headrail. For instance, each lift cord of the first set of lift cords may be a cord, lifting tape, a strip of material, or another type of flexible elongated member. As another example, the second set of lift cords may include cords, lifting tape, strips of material, or other types of flexible elongated members.

Other details, objects, and advantages of the invention will become apparent as the following description of certain present preferred embodiments thereof and certain present preferred methods of practicing the same proceeds.

BRIEF DESCRIPTION OF THE DRAWINGS

Present preferred embodiments of top down bottom up shade are shown in the accompanying drawings and certain present preferred methods of practicing the same are also illustrated therein. It should be appreciated that like reference numbers used in the drawings may identify like components.

DETAILED DESCRIPTION OF PRESENT PREFERRED EMBODIMENTS

Figure 1:
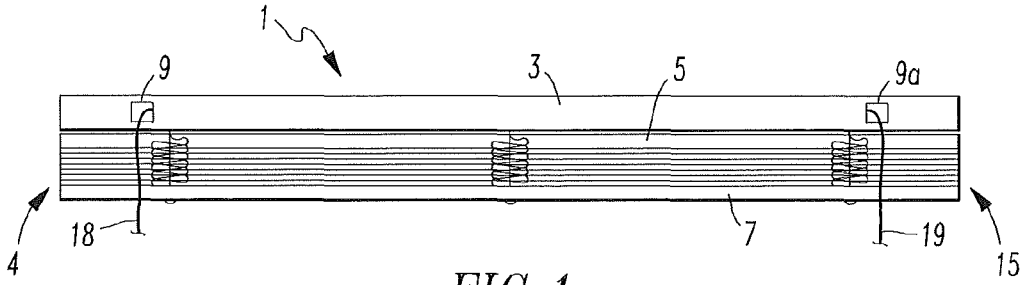
FIG. 1 illustrates a front view of a first present preferred embodiment of a window covering with the middle rail, window covering material and bottom rail being in a retracted, fully raised position.
Figure 2:
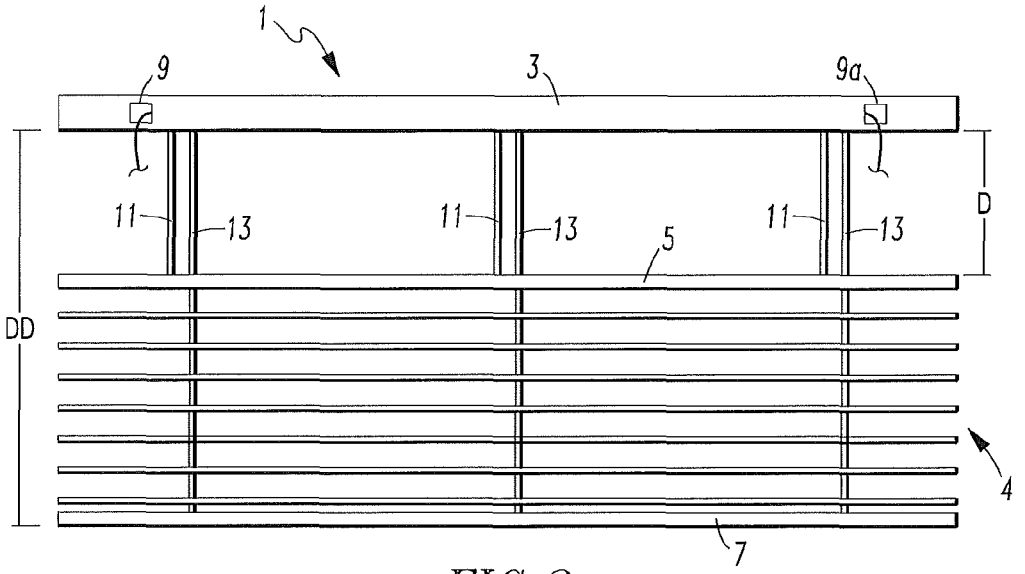
FIG. 2 is a front view of the first present preferred embodiment of the window covering with the middle rail and bottom rail in lowermost positions and the window covering material in an extended position. It should be appreciated that in this lowermost position the middle rail is held a predetermined distance below the headrail.
Figure 3:
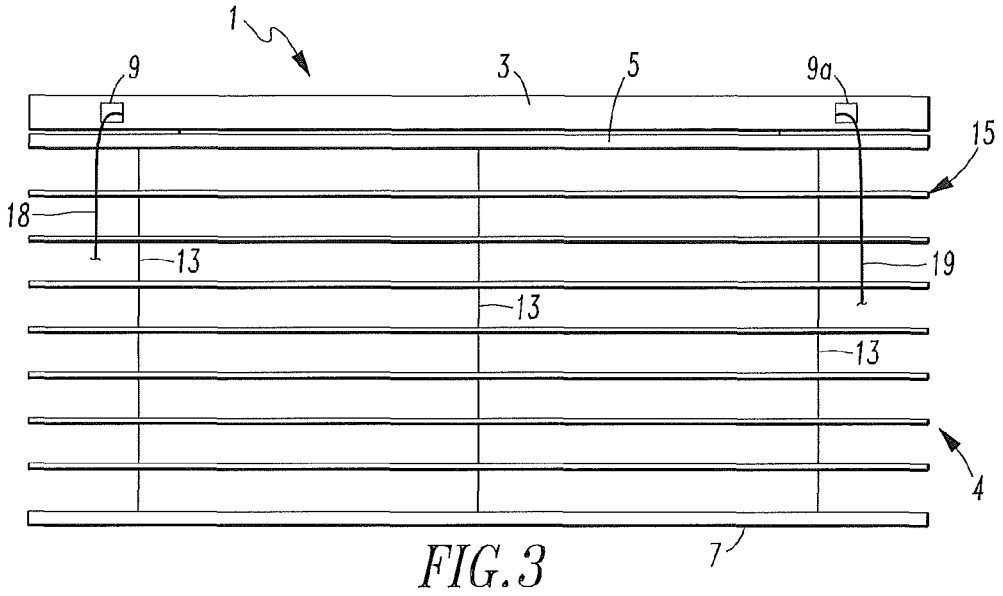
FIG. 3 is a front view of the first present preferred embodiment of the window covering with the middle rail in a raised position and the bottom rail in its lowermost position and the window covering material in an extended position.

Referring to FIGS. 1-4, a window covering may be configured as a top down bottom up shade 1. The shade may have a headrail 3, a bottom rail 7 and a middle rail 5 positioned between the bottom rail 7 and headrail 3. Window covering material 4 that is moveable from a retracted fully raised position shown in FIG. 1 to an extended fully lowered position shown in FIG. 3. The window covering in FIGS. 1-4 is illustrated as a Venetian blind, but other types of window coverings such as pleated shades, Roman shades, and cellular shades can be used as well.

A first set of lift cords 11 may extend between the headrail 3 and the middle rail 5 and may be moveable to move the middle rail relative to the headrail 3 and also extend or retract the window covering material 4. A second set of lift cords 13 may extend from between the headrail 3 and the bottom rail 7. A terminal end of each lift cord of the second set of lift cords may be attached to the bottom rail 7 and an opposite terminal end may be attached to the headrail 3. The second set of lift cords 13 may pass through the middle rail 5 as well. The second set of lift cords 13 may move to extend or retract window covering material 4 positioned between the middle rail 5 and the bottom rail 7. The lift cords may be any type of suitable flexible elongated member. For instance, each lift cord may be a cord, a strip of material or a lifting tape. The window covering material 4 may be any type of material suitable for covering windows, such as slats on ladders 15, pleated material, cellular material, fabric material, now woven fabric, interconnected fabric segments, woven wood or woven grass.

At least one operator cord 18 may extend from a cord lock 9 attached to the headrail 3 so that a user may control positioning of the shade 1 via the one or more operator cords 18 that extend through the cord lock 9 for controlling movement of the second set of lift cords. The one or more operator cords 18 may be a separate cord or may be portions of the second set of lift cords. Alternatively, at least one motor, a loop cord drive, or at least one spring motor may be utilized for controlling the positions of the window covering material, bottom rail 7, and movement of the second set of lift cords 13.

A second cord lock **9*a* may also be attached to the headrail. The second cord lock 9*a* may have one or more operator cords 19 pass through the cord lock to control movement of the first set of lift cords 11 to control movement of the middle rail 5 and window covering material 4. The at least one operator cord 19 may be at least one separate cord that is extendable through the cord lock 9*a* or may be portions of the first set of lift cords that extend through the cord lock 9*a*. In alternative embodiments, a loop cord drive or motor could be utilized instead of the second cord lock 9*a*** for controlling movement of the middle rail and first set of lift cords.

Figure 4:
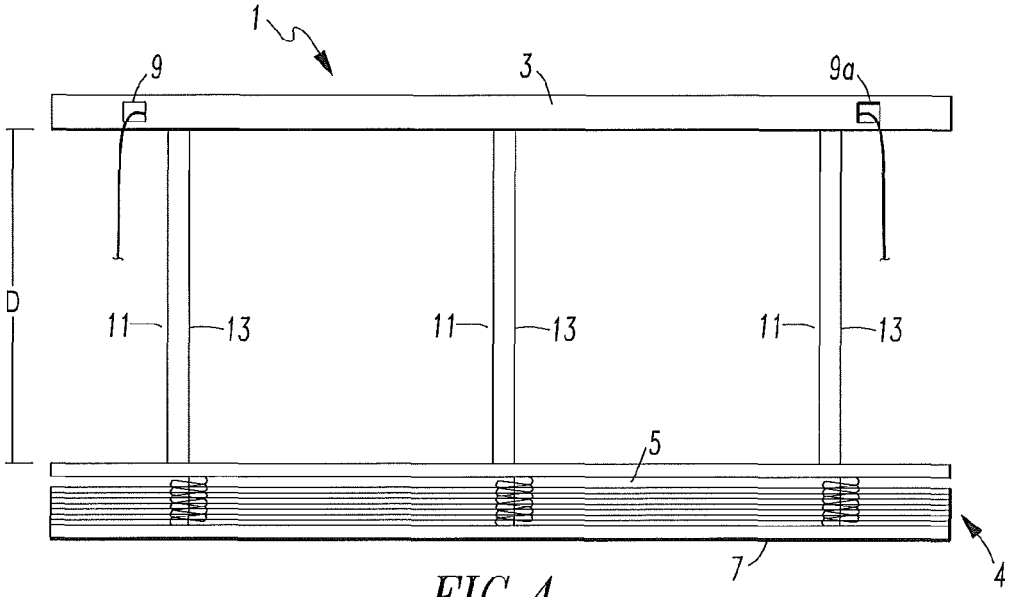
FIG. 4 is a front view similar to FIG. 3 in which the middle rail has been lowered a selected distance to prevent child entanglement and the window covering material is in a retracted position.

The first set of lift cords 11 may be configured to limit the extent to which the middle rail 5 may extend from the headrail 3 as shown in FIG. 4. Preferably, the first set of lift cords is configured such that the first set of lift cords only extend at most a predetermined distance D between the bottom of the headrail 3 and the top of the middle rail 5. For instance, the length of the first set of lift cords may be sized to only permit the middle rail 5 to move away from the headrail 3 by the predetermined distance D. The distance D could be any of a number of distances suitable to prevent the exposed cords that extend from between the headrail 3 and middle rail 5 from being within the reach of a small child. For instance, the predetermined distance D could be at most twelve inches if a window opening has a standard height of between six and eight feet. If the top of the window opening happened to have a taller height, the distance D could be a longer distance. Of course, if the top of the window opening was positioned at a lower height, the distance D could also be shorter than twelve inches.

It should be appreciated that that the distance D should be less than the distance DD between the bottom of the middle rail 5 when the middle rail is in an uppermost position adjacent the headrail 3 and the top of the bottom rail when the window covering material is fully extended. Such a limited moveability of the middle rail prevents the middle rail from moving along the full path of window covering extension as is traditionally done with top down bottom up shades. While such limited movement may hinder a user from having as much freedom in positioning the window covering material as compared to traditional top down bottom up shades, it also improves the safety of such window coverings. For instance, by the distance D being less than the distance DD, the first set of lift cords may be prevented from posing a substantial entanglement risk to small children as it may prevent small children from being able to easily come into contact with such cords.

Figure 5:
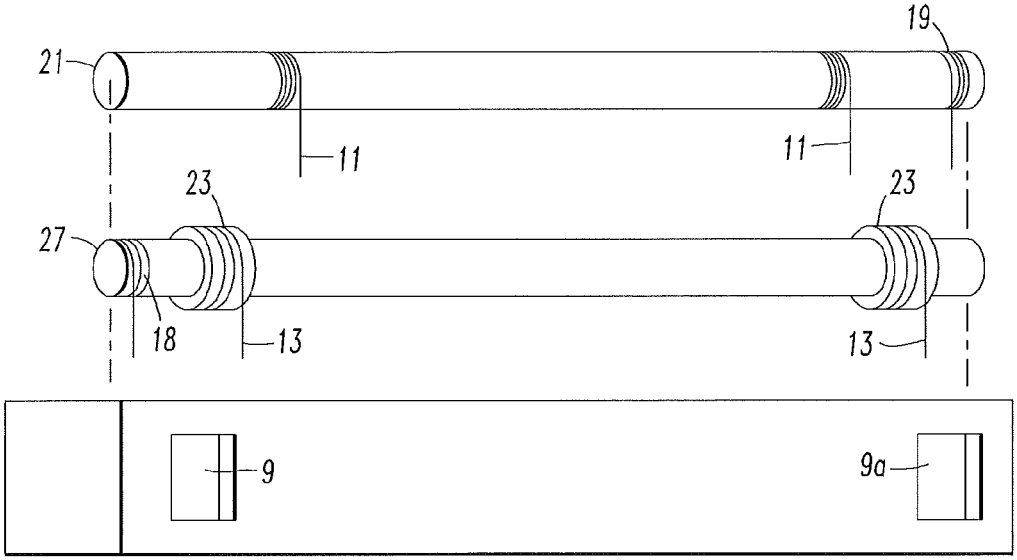
FIG. 5 is a fragmentary exploded view of the first present preferred embodiment of the window covering illustrating an embodiment of the lift system of the window covering.

Referring to FIG. 5, embodiments of the window covering 1 may utilize any of a number of different lift systems 20 for controlling movement of the first set of lift cords 11 and second set of lift cord 13. For instance, a rotatable shaft 21 may be positioned in the headrail 3. The first set of lift cords may be directly wound about the shaft 21 Rotation of the shaft 21 in a first direction may lower the middle rail 5 by unwinding the first set of lift cords. Rotation of the shaft 21 in an opposite second direction may wind up the first set of lift cords to raise the middle rail and bottom rail. At least one operator cord 19 that may extend from the second cord lock 9*a* may be manipulated by a user to effect such rotation of the shaft 21 to control movement of the middle rail 5 and the window covering material 4. For alternative embodiments that use a loop cord drive, rotation of the loop cord of the loop cord drive may actuate rotation of the shaft 21. In yet other alternative embodiments that utilize a motor, the motor may be actuated to drive rotation of the shaft 21.

The second set of lift cords 13 may be extended or retracted by rotation of a rod 27. The rod may be positioned in the headrail adjacent to the shaft 21. The lift cords of the second set of lift cords 13 may be wound or unwound from spools 23 attached to the rod 27. As may be seen from FIG. 8, the second set of lift cords 13 could alternatively be directly wound about the rod 27 instead of being unwound or wound from spools attached to the shaft. The rod 27 may rotate in one direction to unwind and extend the second set of lift cords 13 and may rotate in an opposite direction to wind the second set of lift cords about the spools 23 to retract the second set of lift cords. A user may manipulate at least one operator cord 18 that extends from cord lock 9 to control movement of the second set of lift cords 13, window covering material 4 and bottom rail 7. As noted above, the at least one operator cord 18 may be a separate cord or be portions of the second set of lift cords.

Figure 6:
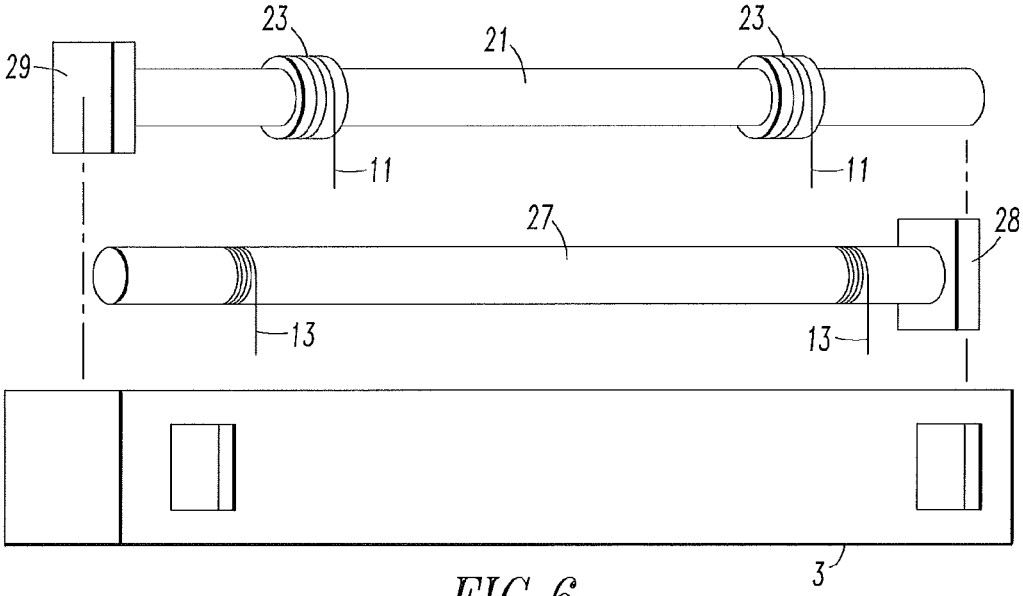
FIG. 6 is a fragmentary exploded view of another present preferred embodiment of the window covering illustrating an alternative lift system that may be utilized in embodiments of the window covering.

In alternative embodiments, the lift system 20 may utilize motors, a loop cord drive, or spring motors to control movement of the shaft 21 and rod 27 as may be understood from FIG. 6. For instance, a motor 29 may be attached to shaft 21 and a spring motor 28 may be attached to the rod 27. The motor 29 may be actuated to rotate the shaft 21 for moving the middle rail 5 via the first set of lift cords 11. The first set of lift cords may be positioned directly on the shaft 21 or may be wound and unwound from spools 23 attached to the shaft 21. It should be understood that other alternative embodiments may replace the motor 28 with a loop cord drive.

The spring motor 28 may be attached to the rod 27 so that a user may move the bottom rail to adjust the position of the bottom rail as is commonly done with cordless shades. The spring motor may maintain the position of the bottom rail at any user desired position. The spring motor 28 may also retract the second set of lift cords 13 to retract the bottom rail if a user provides a slight upward force to the bottom rail 7. Of course, the spring motor 28 could be replaced with a motor that may be actuated by a remote control mechanism or a loop cord drive in alternative embodiments.

Figure 7:
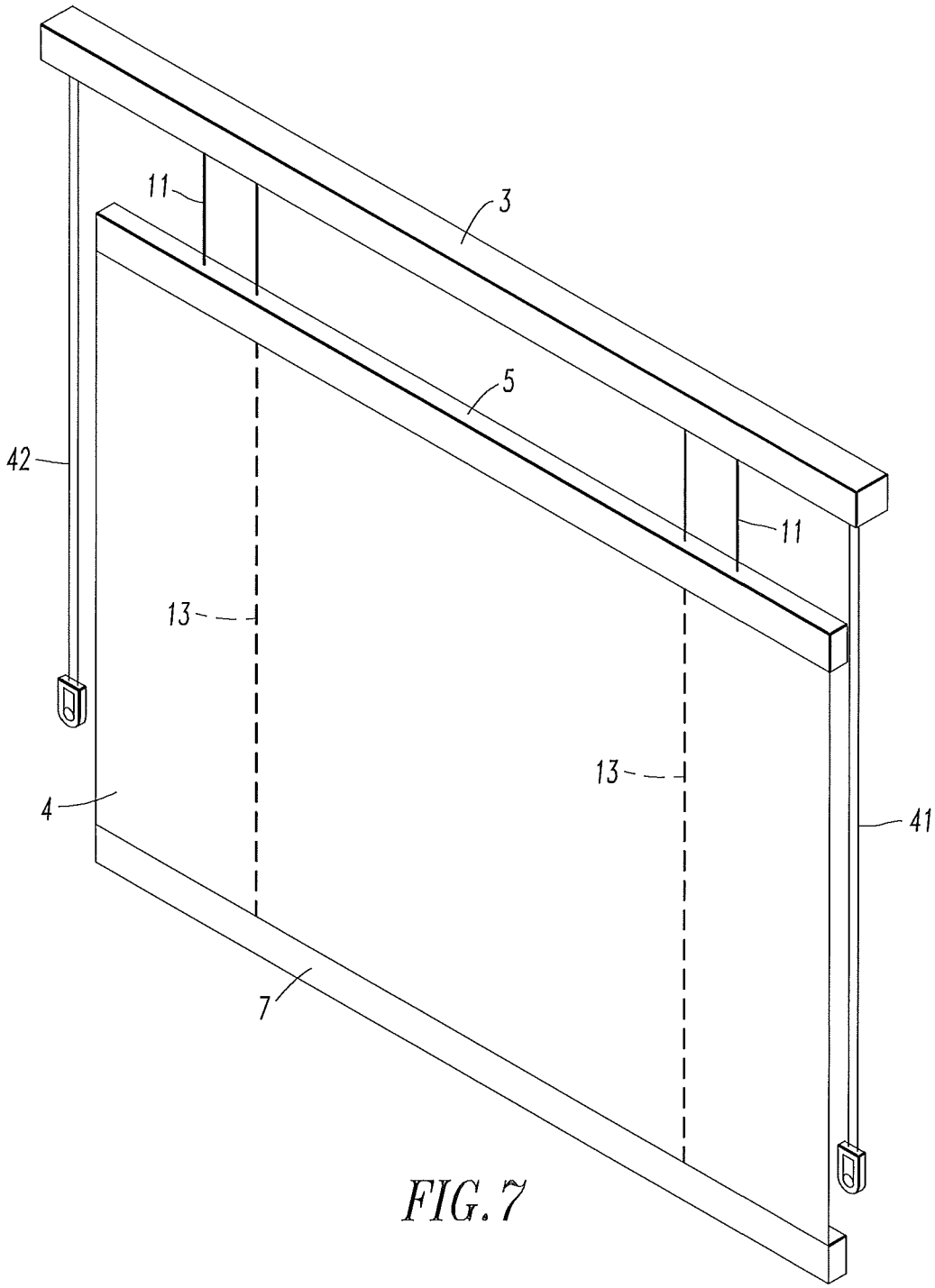
FIG. 7 is a perspective view of yet another present preferred embodiment of a window covering.

For example, as illustrated in FIG. 7, another alternative embodiment of the window covering may utilize a loop cord drive 41 for controlling extension and retraction of the first set of lift cords 11 and a loop cord drive 42 for controlling extension and retraction of the second set of lift cords 13. A user may manipulate the loop cord of the first loop cord drive 41 to control positioning of the middle rail 5 and may manipulate the loop cord of the second loop cord drive 42 to adjust the position of the bottom rail 7.

Figure 8:
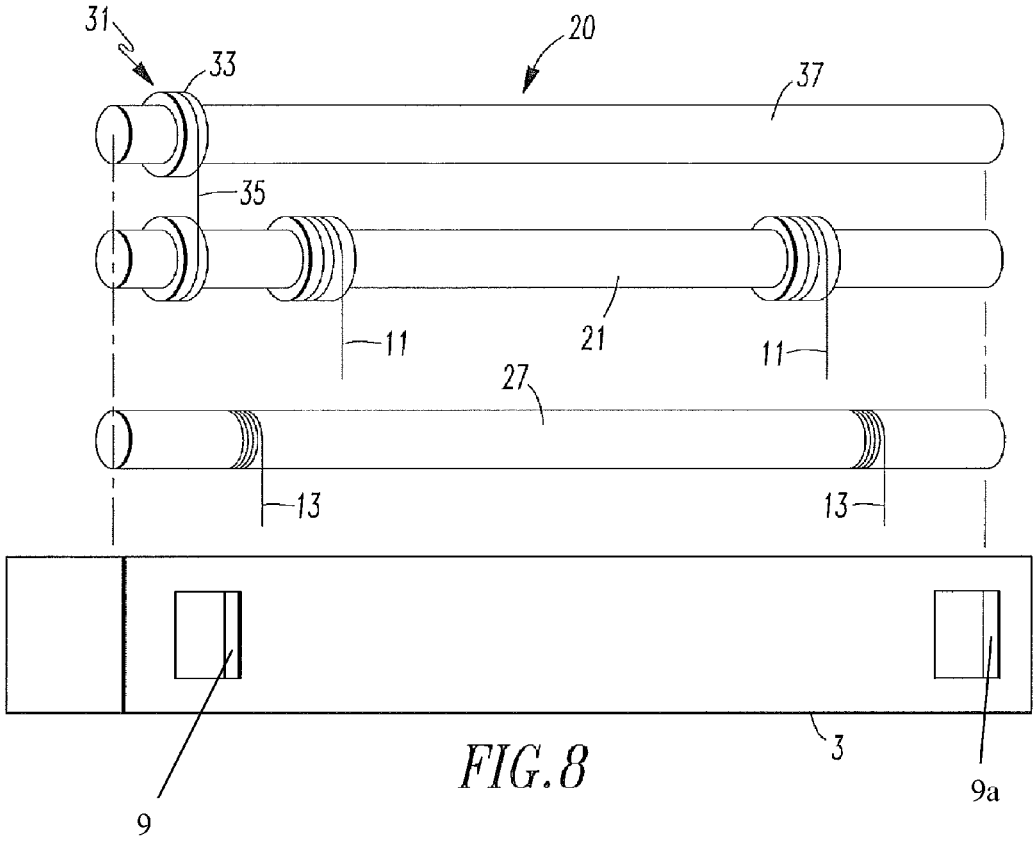
FIG. 8 is a fragmentary exploded view of yet another present preferred embodiment of the window covering showing another alternative lift system that may be utilized in embodiments of the window covering.

Referring to FIG. 8, embodiments of the window covering could also utilize a lift system 20 that interacts with a travel limiting device 31 to control the distance D about which the first set of cords may extend between the middle rail 5 and headrail 3. Such embodiments may not have to rely upon the length of the first set of lift cords to ensure that the middle rail only moves away from the headrail 3 by at most the predetermined distance D. The travel limiting device 31 may include a shaft 37 that has a travel limiting cord 35 wrapped about the shaft 37. Preferably, a spool 33 is attached to the shaft 37 and the travel limiting cord 35 is wound on the spool 33. The travel limiting cord may extend from the spool 33 to the shaft 21, which is rotated to move the first set of lift cords 11. The travel limiting cord 35 may extend from the spool 33 and be wrapped about the shaft 21 when the shaft is rotated in a direction for unwinding and extending the first set of lift cords. When the shaft 21 is rotated sufficiently to extend the first set of lift cords 11 a predetermined distance D, the travel limiting cord 35 may be fully extended from the spool 33 and be wrapped about the shaft 21 to prevent further rotation of the shaft 21 and prevent the first set of lift cords 11 from extending further than the predetermined distance D from the headrail to the middle rail.

Embodiments of the window covering may utilize only one travel limiting cord 35 or may utilize a plurality of spaced apart travel limiting cords 35. The shaft 37 and spool 33 of the travel limiting device 31 may be positioned in the headrail adjacent the shaft 21 or may alternatively be located in the middle rail 5. The use of the travel limiting device 31 can permit a fabricator to control the predetermined distance D by which the middle rail is moveable away from the headrail 3 by merely changing a length of one or more travel limiting cords 35. This may help facilitate adjustments a fabricator may make when fabricating a window covering for a particular customer as it would not be necessary to adjust lengths of any of the first set of lift cords 11. For instance, adjustment of the one or more travel limiting cords 35 may be done much more quickly than a change in length to each of the first set of lift cords.

Further, the user of travel limiting device 31 may permit a fabricator or installer to retrofit previously sold window coverings with a mechanism that prevents a middle rail of a top down bottom up shade from moving beyond a predetermined distance D from the headrail 3 to improve the safety of a previously sold product. Such retrofitting may be done without the need of removing and cutting any lift cords in the existing shade and, as a result, may permit an easier and less costly retrofitting option to an installer. This is particularly true for large window coverings that may utilize three or more lift cords that extend from a headrail for moving a middle rail.

It should be understood that embodiments of the window covering may be designed to meet a particular design objective. For instance, embodiments of the lift system may utilize motors, spring motors, loop cord drives or operator cords extending through cord locks in any of a number of different arrangements to control rotation of the shaft 21 and rod 27 for movement of the middle rail 5, bottom rail 7 and window covering material 4. It should also be understood that rod 27 and shaft 21 could have any of a number of lengths or cross sectional shapes for meeting a particular design objective. For example, the rods 27 and shafts 21 could be generally cylindrical rods or be elongated members that have a polygonal cross sectional shape.

While certain present preferred embodiments of the window covering and certain embodiments of methods of practicing the same have been shown and described, it is to be distinctly understood that the invention is not limited thereto but may be otherwise variously embodied and practiced within the scope of the following claims.

I claim:

1. A window covering comprising:

a headrail;

a bottom rail, the bottom rail having a top and a bottom;

a middle rail positioned between the headrail and the bottom rail, the middle rail having a top and a bottom;

window covering material positioned between the middle rail and the bottom rail, the window covering material moveable from a retracted position to an extended position;

a first set of lift cords extending from the headrail to the middle rail, the first set of lift cords extendable between the headrail and the middle rail to a predetermined distance, the predetermined distance defining a lowermost position of the middle rail relative to the headrail, the first set of lift cords retractable to a wound position for defining an uppermost position of the middle rail, the lowermost position of the middle rail being a lowest position in which the middle rail is moveable, such that the middle rail cannot move beyond the predetermined distance;

a second set of lift cords extending from the headrail to the bottom rail;

the predetermined distance about which the first set of lift cords is extendable being determined such that a distance between the middle rail and headrail when the middle rail is in the lowermost position of the middle rail is less than a distance between the bottom of the middle rail when the middle rail is in the uppermost position of the middle rail and the top of the bottom rail when the bottom rail is in a lowermost position of the bottom rail.

2. The window covering of claim 1 wherein the predetermined distance is twelve inches or less.

3. The window covering of claim 1 wherein the window covering material is comprised of pleated material, cellular material, slats on ladders, fabric material, interconnected fabric segments, non woven fabric material, woven grass or woven wood.

4. The window covering of claim 1 wherein each lift cord of the first set of lift cords is lifting tape, a strip of material, or a flexible elongated member.

5. The window covering of claim 1 wherein the top of the middle rail engages the headrail when the first set of lift cords are moved to a fully retracted position and wherein the bottom of the middle rail engages the top of the bottom rail when the window covering material is in the retracted position.

6. The window covering of claim 1 wherein the second set of lift cords is moveable to adjust a position of the window covering material and to adjust a position of the bottom rail and wherein the second set of lift cords also pass through the middle rail.

7. The window covering of claim 1 further comprising a first cord lock connected to the headrail and a second cord lock connected to the headrail, the first cord lock being operably connected to the first set of lift cords and the second cord lock being operably connected to the second set of lift cords.

8. The window covering of claim 2 further comprising at least one travel limiting device attached to at least one of the headrail and the middle rail, the at least one travel limiting device preventing the first set of lift cords from extending from the headrail to the middle rail beyond the predetermined distance.

9. The window covering of claim 1 wherein the predetermined distance is determined such that the first set of lift cords extend out of the headrail and to the middle rail by at most twelve inches.

10. The window covering of claim 1 further comprising a rotatable shaft adjacent the headrail, the first set of lift cords being windable about the rotatable shaft and being unwindable from the rotatable shaft.

11. The window covering of claim 10 further comprising at least one spool attached to the shaft, the first set of lift cords being windable on the at least one spool when the shaft rotates in a first direction and the first set of lift cords being unwindable from the at least one spool when the shaft rotates in a second direction that is opposite the first direction.

12. The window covering of claim 10 further comprising an actuation mechanism attached to the shaft.

13. The window covering of claim 12 wherein the actuation mechanism is a motor.

14. The window covering of claim 1 further comprising:

a first rotatable shaft adjacent the headrail, the first set of lift cords being windable about the first rotatable shaft and being unwindable from the first rotatable shaft; and a second rotatable shaft adjacent the headrail, the second set of lift cords being windable about the second rotatable shaft and being unwindable from the second rotatable shaft.

15. The window covering of claim 14 further comprising a first actuation mechanism attached to the first shaft and a second actuation mechanism attached to the second shaft.

16. The window covering of claim 15 wherein the first actuation mechanism is a motor or loop cord drive and the second actuation mechanism is a motor or loop cord drive.

17. The window covering of claim 14 further comprising at least one travel limiting device attached to at least one of the headrail and the middle rail, the at least one travel limiting device preventing the first set of lift cords from extending from the headrail to the middle rail beyond the predetermined distance.

18. The window covering of claim 17 wherein the travel limiting device comprises:

at least one of: a spool and a third rotatable shaft; and a travel limiting cord that extends from the at least one of the spool and the third rotatable shaft to the first shaft such that the travel limiting cord winds about the first shaft when the middle rail is moved away from the headrail to limit extension of the first set of lift cords from the headrail to the middle rail to the predetermined distance.

19. The window covering of claim 18 wherein the predetermined distance is determined such that the first set of lift cords is extendable out of the headrail to the middle rail by at most twelve inches.

20. A window covering comprising:

a headrail;

a bottom rail, the bottom rail having a top and a bottom;

a middle rail positioned between the headrail and the bottom rail, the middle rail having a top and a bottom;

window covering material positioned between the middle rail and the bottom rail, the window covering material moveable from a retracted position to an extended position;

a first set of lift cords extending from the headrail to the middle rail, the first set of lift cords extendable between the headrail and the middle rail to a predetermined distance, the predetermined distance defining a lowermost position of the middle rail relative to the headrail, the lowermost position of the middle rail being a lowest position in which the middle rail is moveable, such that the middle rail cannot move beyond the predetermined distance, the first set of lift cords retractable to a wound position for defining an uppermost position of the middle rail;

a second set of lift cords extending from the headrail to the bottom rail;

a first rotatable shaft within the headrail, the first set of lift cords being windable about the first rotatable shaft and being unwindable from the first rotatable shaft;

a second rotatable shaft within the headrail, the second set of lift cords being windable about the second rotatable shaft and being unwindable from the second rotatable shaft;

at least one travel limiting device positioned in the headrail, the at least one travel limiting device preventing the first set of lift cords from extending from the headrail to the middle rail beyond the predetermined distance, the predetermined distance about which the first set of lift cords is extendable from the headrail to the middle rail being determined such that a distance between the middle rail and headrail when the middle rail is in the lowermost position of the middle rail is less than a distance between the bottom of the middle rail when the middle rail is in the uppermost position of the middle rail and the top of the bottom rail when the bottom rail is in a lowermost position of the bottom rail.

21. A window covering comprising:

a headrail;

a bottom rail, the bottom rail having a top and a bottom;

a middle rail positioned between the headrail and the bottom rail, the middle rail having a top and a bottom;

window covering material positioned between the middle rail and the bottom rail, the window covering material moveable from a retracted position to an extended position;

a first set of lift cords extending from the headrail to the middle rail, the first set of lift cords extendable between the headrail and the middle rail to a predetermined distance, the predetermined distance defining a lowermost position of the middle rail relative to the headrail, the first set of lift cords retractable to a wound position for defining an uppermost position of the middle rail;

a second set of lift cords extending from the headrail to the bottom rail;

a first rotatable shaft within the headrail, the first set of lift cords being windable about the first rotatable shaft and being unwindable from the first rotatable shaft;

a second rotatable shaft within the headrail, the second set of lift cords being windable about the second rotatable shaft and being unwindable from the second rotatable shaft;

at least one travel limiting device positioned in the headrail, the at least one travel limiting device preventing the first set of lift cords from extending from the headrail to the middle rail beyond the predetermined distance, the predetermined distance about which the first set of lift cords is extendable from the headrail to the middle rail being less than a distance between the bottom of the middle rail when the middle rail is in the uppermost position of the middle rail and the top of the bottom rail when the bottom rail is in a lowermost position of the bottom rail; and wherein the at least one travel limiting device is comprised of a third shaft, at least one third cord being windable and unwindable about the third shaft, when the third shaft rotates in a first direction the at least one third cord being windable about the third shaft and when the third shaft rotates in a second direction that is opposite the first direction the at least one third cord being unwound from the third shaft, the at least one third cord extending to the first shaft, when the middle rail is moved from to the lowermost position of the middle rail the at least one third cord unwinding from the third shaft and winding about the first shaft to a maximum extent that prevents the first shaft from being rotated to unwind the first set of lift cords such that the middle rail is prevented from being lowered below the predetermined distance.

22. The window covering of claim 21 wherein the predetermined distance is twelve inches or less.

23. The window covering of claim 21 wherein the predetermined distance is determined such that the first set of lift cords extend out of the headrail and to the middle rail by at most twelve inches.

* * * * *